US009776646B2

(12) United States Patent
Kreuzweger et al.

(10) Patent No.: US 9,776,646 B2
(45) Date of Patent: Oct. 3, 2017

(54) WHEELSET BEARING FOR THE WHEELSET OF A RAIL VEHICLE HAVING AN INTERNALLY MOUNTED TRUCK

(71) Applicant: Siemens Oesterreich, Vienna (AT)

(72) Inventors: David Kreuzweger, Graz (AT); Christian Kueter, Stattegg (AT); Martin Teichmann, Graz (AT)

(73) Assignee: Siemens AG Österreich, Vienna (AT)

( * ) Notice: Subject to any disclaimer, the term of this patent is extended or adjusted under 35 U.S.C. 154(b) by 19 days.

(21) Appl. No.: 14/785,003

(22) PCT Filed: Apr. 22, 2014

(86) PCT No.: PCT/EP2014/058078
§ 371 (c)(1),
(2) Date: Oct. 16, 2015

(87) PCT Pub. No.: WO2014/177417
PCT Pub. Date: Nov. 6, 2014

(65) Prior Publication Data

US 2016/0082986 A1 Mar. 24, 2016

(30) Foreign Application Priority Data

May 2, 2013 (AT) ..... A 50297/2013

(51) Int. Cl.
*B61F 15/00* (2006.01)
*B61F 15/20* (2006.01)
*B61F 5/24* (2006.01)

(52) U.S. Cl.
CPC ..... *B61F 15/20* (2013.01); *B61F 5/24* (2013.01)

(58) Field of Classification Search
CPC ..... B61F 15/00; B61F 15/02; B61F 15/08; B61F 15/12; B61F 15/16; B61F 15/18; B61F 5/24
See application file for complete search history.

(56) References Cited

U.S. PATENT DOCUMENTS 1,875,380 A * 9/1932 Howard et al. ..... B61H 13/24 105/182.1
2,080,180 A * 5/1937 Messier ..... B61F 5/24 105/171

(Continued)

FOREIGN PATENT DOCUMENTS

CN 101395017 3/2009
CN 101934799 1/2011

(Continued)

OTHER PUBLICATIONS

Office Action dated Oct. 8, 2016 which issued in the corresponding Chinese Patent Application No. 201480024891.2.

(Continued)

*Primary Examiner* — Jason C Smith
(74) *Attorney, Agent, or Firm* — Cozen O'Connor

(57) ABSTRACT

A wheelset bearing for the wheelset of a rail vehicle having an internally mounted truck that includes one bearing housing per side of the wheelset that encloses the wheelset bearing for the wheelset, where the wheelset bearing and bearing housing are within the wheels in an installed state and a torsion spring serves as a roll stabilizer that is connected to the bearing housing such that the torsion springs are rigidly connected to one bearing housing each on the two ends thereof (without interconnection of draw-pressure rods) so as to implement roll stabilization for the wheelsets in a manner that is as technically simple as possible.

18 Claims, 4 Drawing Sheets

(56) References Cited

U.S. PATENT DOCUMENTS

| | | | | | |
|---|---|---|---|---|---|
| 2,330,912 | A * | 10/1943 | Pflager | B61C 9/50 | 105/133 |
| 2,473,714 | A * | 6/1949 | Krotz | B61F 3/16 | 105/178 |
| 4,362,109 | A * | 12/1982 | Panagin | B61F 3/02 | 105/169 |
| 4,538,525 | A * | 9/1985 | Jackson | B61F 5/10 | 105/190.2 |
| 5,024,165 | A * | 6/1991 | Panagin | B61F 5/148 | 105/165 |
| 8,056,482 | B2 * | 11/2011 | Rodet | B61F 3/04 | 105/133 |
| 8,056,484 | B2 * | 11/2011 | Brundisch | B61F 5/24 | 105/199.2 |
| 8,171,861 | B2 * | 5/2012 | Rodet | B61C 9/44 | 105/136 |
| 8,381,659 | B2 * | 2/2013 | Rodet | B61D 13/00 | 105/133 |
| 2008/0118195 | A1 * | 5/2008 | Ishikawa | B61F 15/20 | 384/448 |
| 2009/0000368 | A1 | 1/2009 | Pruckner | | |
| 2010/0307371 | A1 | 12/2010 | Rodet | | |
| 2016/0368512 | A1 * | 12/2016 | Wang | B61F 5/325 | |

FOREIGN PATENT DOCUMENTS

| | | | |
|---|---|---|---|
| CN | 103010248 | | 4/2013 |
| DE | 739755 | | 10/1943 |
| DE | 1148575 | B | 5/1963 |
| DE | 19532832 | C1 | 12/1996 |
| DE | 19819412 | C1 | 10/1999 |
| EA | 010229 | | 6/2008 |
| EA | 013652 | | 6/2010 |
| EP | 0399345 | A1 | 11/1990 |
| FR | 2702709 | A1 | 9/1994 |
| GB | 220146 | A | 8/1924 |
| GB | 2050273 | A | 1/1981 |

OTHER PUBLICATIONS

Office Action dated May 27, 2017 which issued in the Chinese Patent Application No. 201480024891.2.

* cited by examiner

WHEELSET BEARING FOR THE WHEELSET OF A RAIL VEHICLE HAVING AN INTERNALLY MOUNTED TRUCK

CROSS-REFERENCE TO RELATED APPLICATIONS

This is a U.S. national stage of application No. PCT/EP2014/058078 filed 22 Apr. 2014. Priority is claimed on Austrian Application No. A50297/2013 filed 2 May 2013, the content of which is incorporated herein by reference in its entirety.

BACKGROUND OF THE INVENTION

1. Field of the Invention

The invention relates to a wheelset bearing for the wheelset of a rail vehicle having a truck with internally mounted bearing, comprising one bearing housing per side of the wheelset, where the bearing housing encloses the wheelset bearing for a wheel, wheelset bearing and bearing housing are located inside the wheels in the installed state, and a torsion spring which serves as a roll stabilizer and is connected to the bearing housing.

A wheelset in rail vehicles consists of the wheelset axle and the two wheel disks or wheels. Brake disks or drive components can also be mounted on the wheelset axle. The wheelset is supported in the truck by the wheelset bearing. In railroad vehicles, the two wheels of a wheelset are usually fixedly connected to the axle on account of the sinusoidal trajectory described and co-rotate therewith. For this reason reference is made in this context to wheelset and accordingly to wheelset bearing. The wheelset bearings guide the wheelset laterally in the truck and also transmit longitudinal forces when the wheelset is driven or braked. The wheelset bearing is typically implemented as a roller bearing that is seated in the wheelset bearing housing and supports the wheelset.

2. Description of the Related Art

In rail vehicles, but also in other vehicles, the car body is usually spring-mounted relative to the wheelsets by way of one or more suspension stages. The centrifugal acceleration acting transversely to the direction of travel and consequently to the vehicle longitudinal axis such as occurs during curving is responsible, due to the comparatively high center of gravity of the car body, for the tendency of the car body to tilt with respect to the wheelsets toward the outside of the curve, in other words, therefore, to execute a rolling motion about a roll axis parallel to the vehicle longitudinal axis. Above certain threshold values such rolling motions detract from the ride comfort on the one hand. On the other hand, they entail the risk of infringing the permissible minimum clearance outline as well as, with regard to derailment safety, provoking unacceptable unilateral losses of wheel load.

In order to prevent this, stabilizing mechanisms in the form of devices known as roll stabilizers are generally used. Their function is to oppose the rolling motion of the car body with a resistance in order to lessen said motion, while the rising and falling motions of the car body with respect to the wheelsets or the chassis are not to be impeded. Running gear or chassis is the term applied to that part of a rail vehicle by which the vehicle travels and is guided on the rails. A running gear having two or more wheelsets arranged in a frame is referred to as a truck.

Such roll stabilizers are known in a variety of hydraulically or purely mechanically acting implementations. Use is often made of a torsion shaft, also referred to as a torsion bar or torsion spring, extending transversely to the longitudinal direction of the vehicle, as is known for example from DE 198 19412 C1.

Seated on the torsion shaft on both sides of the vehicle longitudinal axis are levers that are mounted in a rotationally fixed manner and extend in the vehicle longitudinal direction. These levers are in turn connected to control arms or connecting rods that are arranged kinematically parallel to the suspension devices of the vehicle. When the springs of the suspension devices of the vehicle are compressed, the levers seated on the torsion shaft are set into rotational motion via the control arms to which they are connected. If, during negotiation of curves, a rolling motion occurs with the suspension devices on either side of the vehicle experiencing different degrees of spring deflection, this results in different angles of rotation of the levers seated on the torsion shaft. The torsion shaft is accordingly subjected to a torsional moment which, depending on its torsional stiffness, it compensates for at a certain torsional angle by a countermoment resulting from its elastic deformation, thus preventing a further rolling motion. On rail vehicles fitted with trucks, the stabilizing device can in this case be provided for the secondary suspension stage, i.e., acting between a chassis frame and the car body. Equally, the stabilizing device can also be utilized in the primary suspension stage, i.e., operating between the wheel units and a chassis frame, as in DE 19819412 C1.

Inside bearing trucks, where the axle bearings and the frame components are located between the wheels or wheel disks, have smaller dimensions transversely to the direction of travel than outside bearing trucks, which means that inside bearing trucks provide a correspondingly smaller base for supporting the primary suspension stage. If the stiffness ratings of the primary springs are similar to those in the case of outside bearing trucks, the roll angle increases and the vehicle can come into conflict with the kinematic gauge. The kinematic gauge defines the maximum space envelope that can be occupied by vehicles to ensure they remain within the infrastructure minimum clearance outline. For this purpose, the maximum possible movement of the vehicle is considered, with both lateral and vertical vehicle motions being taken into account, which are calculated under different load conditions based on the vehicle geometry and suspension characteristics.

One possibility of roll stabilization is to install a primary roll stabilizer (comprising torsion springs, levers, tie/push rods and a mounting for the torsion spring on the truck frame) between the wheels, even in the case of inside bearing trucks, as is shown specifically in DE 19819412 C1. However, such roll stabilizers, with the various components and with the mounting on the truck frame, constitute a technically complex solution.

Another possibility for reducing the roll angle and consequently for increasing the suspension anti-roll stiffness is to increase the primary suspension stiffness rather than to use a roll stabilizer. However, this has the disadvantage that higher accelerations occur on the car body, thus reducing the ride comfort for any passengers.

SUMMARY OF THE INVENTION

It is therefore an object of the present invention to provide a wheelset bearing or, as the case may be, an inside bearing truck which does not increase the pitching stiffness characteristics of the primary suspension, but rather, through the use of a torsion spring, affords a roll stabilization for the wheelsets that is as technically simple as possible.

This and other objects and advantages are achieved in accordance with the invention by a wheelset bearing for the wheelset of a rail vehicle having an inside bearing truck that comprises one bearing housing per side of the wheelset, where the bearing housing encloses the wheelset bearing for the wheelset, the wheelset bearing and bearing housing are located inside the wheels in the installed state, and a torsion spring that serves as a roll stabilizer and that is connected to the bearing housings.

In accordance with the invention, the torsion spring is rigidly connected to one bearing housing at each of its two ends (without tie/push rods being connected therebetween).

The torsion spring is therefore rigidly connected, and consequently also connected in a rotationally fixed manner, to the two bearing housings, whereas conventional torsion springs are connected to the bearing housings by way of levers and articulated joints and consequently at their ends are at least rotatably connected to the bearing housings. The inventive mounting of the torsion spring occurs exclusively by way of the connection to the wheelset bearing housing, referred to as the bearing housing for short.

In this arrangement the guiding of the wheelset, i.e., the connection and transmission of force from the wheelset bearing in accordance with the invention to the truck frame, can be realized in a variety of ways. Thus, the transmission of force can occur via separate coupling elements (such as linkages or control arms) or else directly by way of the primary suspension elements themselves. A commonly employed and advantageous implementation is a device known as a motion link, in which the wheelset bearing housing is connected in an articulated manner to the truck frame by way of a wheelset guide bushing.

The wheelset bearing housings can also have projections that point away from the wheel axis and the torsion spring can be secured to the projections. The wheel axis is that straight line which runs through the center points of the two bearing bushings.

The middle section of the torsion spring is typically arranged spaced at a distance from and parallel to the wheel axis. A particularly beneficial embodiment, insofar as the wheelset guidance is implemented as a motion link, proves to be an arrangement in proximity to the connecting line between the two wheelset guide bushings, because in this case the flexing component during the torsion is small. In proximity to the connecting line is to be understood in this context in the sense that the middle section of the torsion spring is arranged closer to the connecting line than to the wheel axis and/or that the middle section of the torsion spring is at approximately the same radial distance from the wheel axis as the connecting line.

The ends of the torsion spring are connected to the bearing housings in a torsionally rigid and play-free manner.

In a particularly simple embodiment, the torsion spring is fabricated in one piece and is directly connected to one bearing housing in each case, in other words is manufactured from a single piece of a specific material. It is then necessary for its two ends to be formed differently from the longitudinal direction of the torsion spring so that these can be connected to the bearing housings and consequently can build up the torsional moment when the degree of spring compression is different on the two sides. The middle section of the torsion spring, i.e., the torsion spring minus the ends, then takes over the torsional moment.

In the case of the one-piece fabrication of the torsion spring, the ends of the torsion spring can be formed by bending relative to the middle section of the torsion spring. In this way, a straight metal rod, e.g., receives the desired shape by being bent at a point close to each of its two ends. In this case, the middle section of the torsion spring is usually longer than a bent-round end.

The roll stabilizer can, however, also be fabricated from a plurality of parts, whereby levers are fixedly joined to the torsion spring at the ends of the torsion spring and include an angle with the longitudinal direction of the torsion spring. In this way, the levers can be connected to the torsion spring, i.e., to the middle section of the roll stabilizer, in a force-fitting or form-fitting manner. In the case of this embodiment, the torsion spring is generally formed straight over its entire length.

In principle, the torsion spring and possibly also the levers for mounting the torsion spring to the bearing housings can be manufactured via different fabrication methods, such as milled, welded, cast or forged parts. In a multi-part roll stabilizer, consisting, for instance, of a torsion spring and levers, a plurality of different fabrication methods can also find application.

In a simple embodiment of the invention, at least (namely in the case of the one-part torsion spring) the middle section of the torsion spring is rod-shaped. That is, the middle section is straight, has the same cross-section over its length, for instance truly circular, and its length is equal to a multiple of its diameter. In this simple embodiment, the torsion spring is usually fabricated from spring steel. In the case of a multi-part roll stabilizer consisting of a torsion spring and levers, the entire torsion spring is formed in the shape of a rod.

As well as roll stabilization, the torsion spring can also take on additional functions, such as serving as a carrier for one or more brake actuators. Thus, e.g., caliper brakes can be mounted on the torsion spring, which caliper brakes then, in the installed state (with wheelset), can be brought into engagement with brake disks on the wheelset axle.

If the wheelset bearing in accordance with the invention is provided with a wheelset, one or more brake disks can accordingly be mounted on the wheelset axle.

If a wheelset bearing in accordance with the invention is installed with a wheelset in an inside bearing truck, it can be provided that the bearing housing is connected in an articulated manner to the truck frame by way of a wheelset guide bushing, while no direct connection exists between truck frame and torsion spring. This constitutes a difference from conventional roll stabilizers because in such conventional stabilizers the torsion spring is usually connected to the truck frame by way of a rotary joint.

In the configuration the middle part of the torsion spring can be arranged parallel to the wheel axis in proximity to the connecting line between the two wheelset guide bushings.

An embodiment of the invention consists in a bearing being provided in each wheelset guide bushing for realizing the connection to the frame of the truck, the axes of rotation of the bearing including an angle with the middle section of the torsion spring. The angles are equal in size for the two bearings of a wheelset and are symmetrical to the longitudinal median plane of the truck.

This inclination of the bearing axes has the same effect as an inclination of the tie/push rods in a conventional torsion spring: The tie/push rods of a torsion spring are usually arranged parallel to one another in a vertical plane (i.e., a plane normal to the axis of the torsion spring). If the ends of the tie/push rods facing away from the torsion spring are now displaced outward, the tie/push rods (when viewed in the transverse direction) include an angle with the vertical. In the event of a lateral oscillation of the car of the rail vehicle this leads to a stiffer supporting of the car and as a result the rolling motion is reduced.

The inclination of the bearing axes also causes a rotary motion to be induced in the bearings in the event of a lateral oscillation of the car, which is of course mounted on the truck, although this rotary motion does not lead to a perceptible rotation, but merely pretensions the torsion spring. As a result, the stiffness of the torsion spring is increased.

In addition or alternatively to the use of the roll stabilizer as a carrier for brake actuators, it can be provided that at least the middle section of the torsion spring is part of a torque support for a wheelset drive when a wheelset bearing in accordance with the invention is installed together with a drive wheelset in an inside bearing truck. The drive torques are then directly supported at the roll stabilizer and not, as in conventional approaches, introduced into the truck frame.

The contemplated embodiments of the invention apply the principle of the primary roll stabilizers, but dispenses with the tie/push rods and the separate mounting of the torsion spring on another component (the truck frame). The torsion spring is directly connected to the wheelset bearing housings of the truck. The function of the mounting of the torsion spring on the truck is replaced by the connection to the wheelset bearing housings.

Compared with conventional roll stabilization systems, an advantage is produced in terms of costs, technical complexity and weight, because the tie/push rods, their mountings and also the mounting of the torsion spring are omitted. The system in accordance with the invention is therefore lighter and more compact. If the structure of the torsion spring provides corresponding connecting points, the torsion spring can also take on additional functions such as the connection of brake actuators (caliper brakes) and/or a torque support for a drive.

The wheelset bearing in accordance with the invention is not limited to one per chassis or truck. A plurality of such wheelset bearings, typically two, may be present per chassis.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the interests of further explanation of the invention, reference is made in the following part of the description to the figures, from which further advantageous embodiments, details and developments of the invention may be derived, in which.

DETAILED DESCRIPTION OF THE EXEMPLARY EMBODIMENTS

Figure 1:
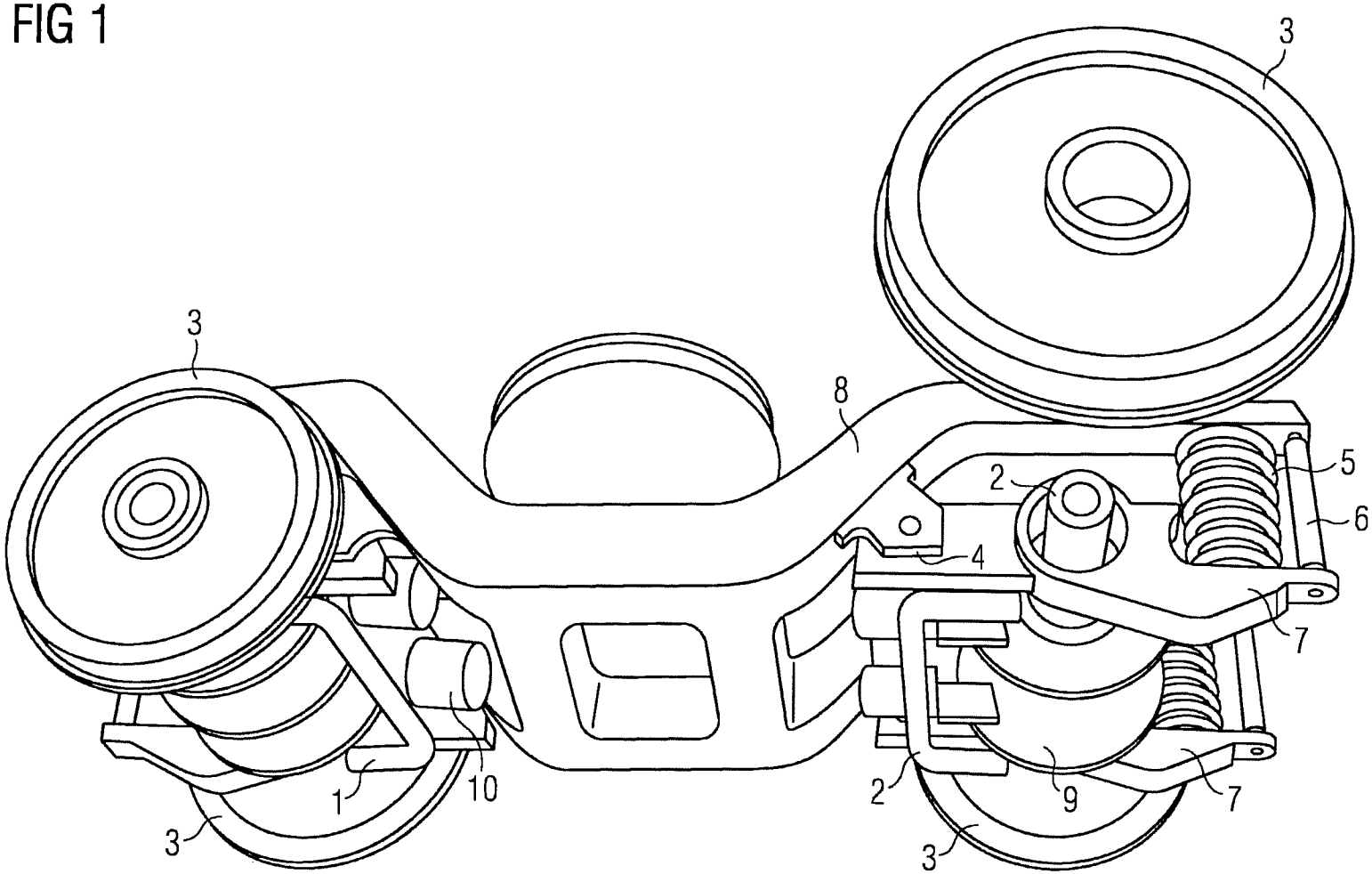
FIG. 1 shows a truck having two wheelset bearings in accordance with the invention in a perspective view.

FIG. 1 depicts a truck frame 8 having two wheelset bearings in accordance with the invention, the front right-hand wheel 3 being shown detached to reveal the bearing housing 7 and the primary suspension, consisting of spring 5 and optionally in addition of a damper 6 (instead of the damper 6 it would of course also be possible to use self-damping springs 5). For illustrative purposes, the wheelset guide principle of the motion link has been chosen by way of example. The bearing housing 7 has an arm that carries spring 5 and damper 6, as well as, on the opposite side, a further arm having at its end a wheelset guide bushing 4 by which the wheelset is pivot-mounted in the truck frame 8. In this instance, the wheelset axle 2 has four brake disks 9 arranged in two pairs. The associated brake actuators 10 are mounted on the truck frame 8. The wheelset bearing, which encloses the wheelset axle at its ends and is mounted in the bearing housing 7, is not visible here. The two bearing housings 7 are connected to the torsion spring 1.

Figure 2:
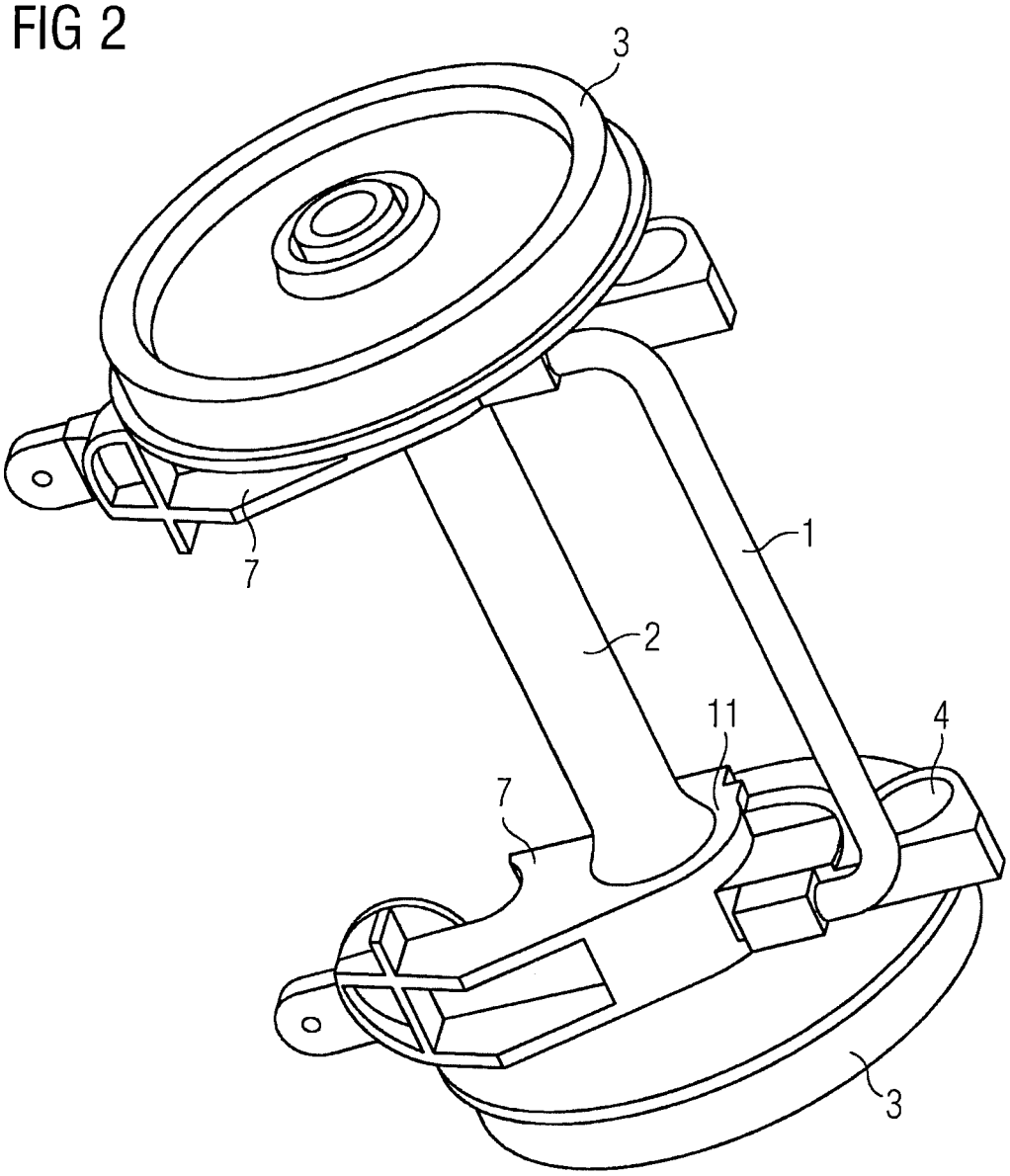
FIG. 2 shows a wheelset bearing of FIG. 1 in a perspective view, seen from below.

FIG. 2 shows only the wheelset, consisting of two wheels 3 and the wheelset axle 2 connecting these, and the two bearing housings 7 from FIG. 1. The wheelset axle 2 is mounted in the wheelset bearings 11. The torsion spring 1 is attached on the underside of the arm, where the wheelset guide bushing 4 that is press-fitted into the bearing housing 11 is provided. In this case, the torsion spring 1 is form in a rod-shaped with a round cross-section, the two ends being bent round through approximately 90° so that the ends coincide with the two arms of the bearing housing 7. In this arrangement, the ends are fixedly connected to the bearing housing 7. The middle section of the torsion spring 1 lies parallel and in proximity to the connection between the two wheelset guide bushings 4 and in a plane normal to the direction of travel.

Figure 3:
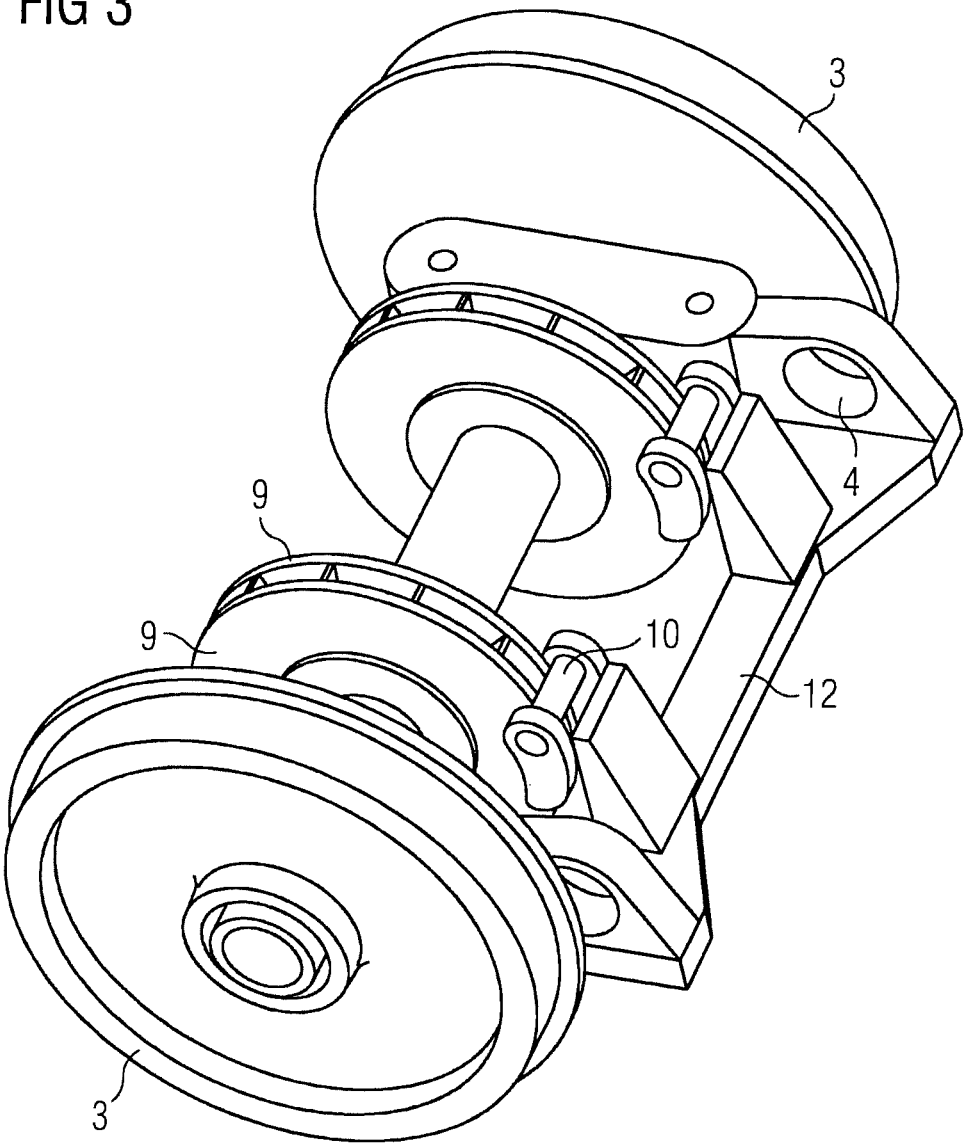
FIG. 3 shows a plan view onto an alternative wheelset bearing having brake actuators in a perspective view, seen from above.

FIG. 3 shows an alternative embodiment of a torsion spring 12 that is formed as straight and is connected directly to the bearing housing 7. The torsion spring 12 is wider than it is high, viewed in the direction of travel, and has caliper brakes 10 on its top side that cooperate with the associated pairs of brake disks 9. No further torsion spring, as for instance in the form of the torsion spring 1 from FIGS. 1 and 2, is provided.

In this case, the torsion spring 12 lies roughly in a horizontal plane with the wheelset axle 2. Viewed in the direction of travel, the torsion spring lies largely inside the wheelset guide bushings 4.

Figure 4:
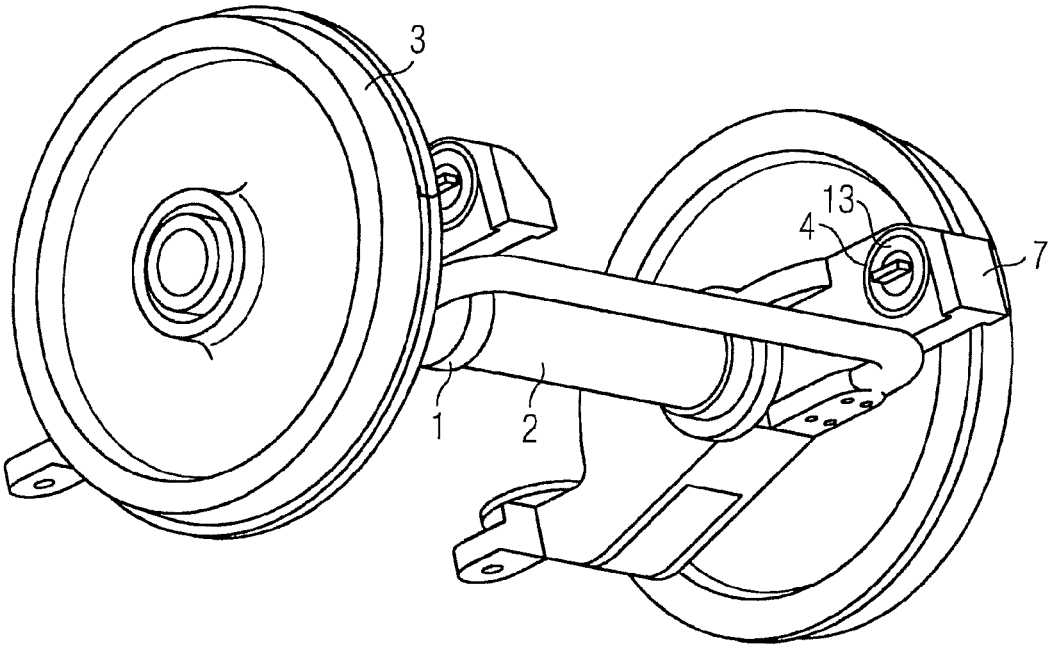
FIG. 4 shows a wheelset bearing of FIG. 1 in a perspective view, seen from below, having bearings inclined at an angle for the connection to the truck frame.
Figure 5:
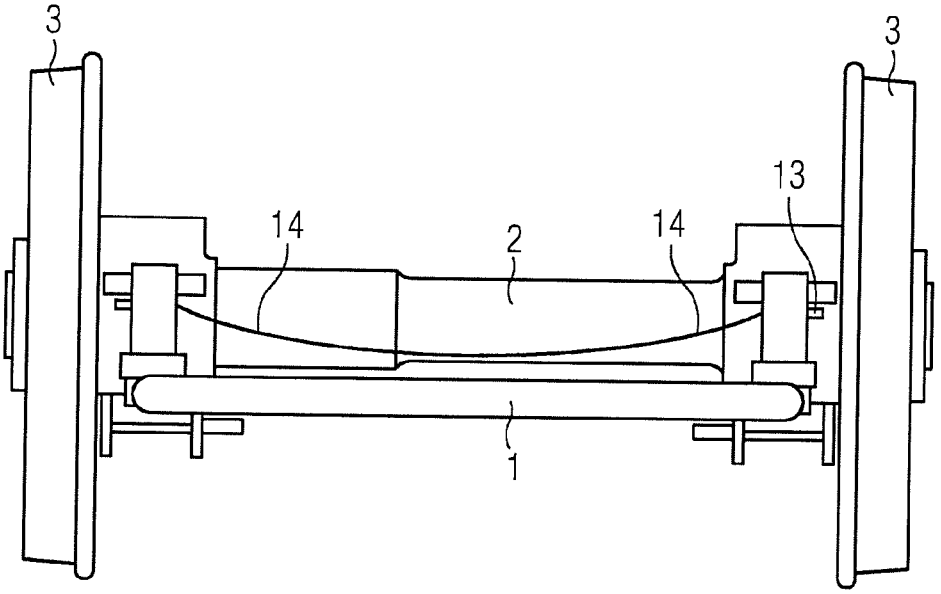
FIG. 5 shows a side view of a wheelset bearing of FIG. 4.

As shown in FIGS. 4 and 5, a bearing 13 is provided in each of the two wheelset guide bushings 4 for realizing the connection to the frame 8 (see FIG. 1) of the truck. The axes of rotation 14 of the bearing 13 include an angle with the longitudinal axis of the middle section of the torsion spring 1; they are inclined downward with respect thereto (or, as the case may be, to the horizontal) inside the bearing housing 7. The angles are of equal magnitude for the two bearings 13 of the same wheelset and are symmetrical to the longitudinal median plane of the frame 8 of the truck. The angle typically amounts to a few degrees and can lie approximately in the range up to 20°.

The bearings 13 can be formed as journal or link bearings. The bearing 13 enables the wheelset guide bushing 4 (and hence the bearing housing 7) to rotate about the axis of rotation 14 of the bearing 13. Engaging with the bearing 13 is, for example, a motion link which is part of the frame of the truck 8 and which consequently is rigidly connected at its other end to the frame 8 of the truck.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A wheelset bearing for a wheelset of a rail vehicle having an inside bearing truck, comprising one bearing housing per side of the wheelset, each bearing housing enclosing a wheelset bearing for the wheelset, and the wheelset bearing and bearing housing being located inside the wheels in an installed state; and a torsion spring comprising a roll stabilizer, said torsion spring being connected transversely to the bearing housings;

wherein the torsion spring is rigidly connected to one bearing housing at each of its two ends without tie/push rods being connected therebetween.

2. The wheelset bearing as claimed in claim 1, wherein a middle section of the torsion spring is arranged spaced at a distance from and parallel to a wheel axis.

3. The wheelset bearing as claimed in claim 2, wherein at least the middle section of the torsion spring serves as a carrier for at least one brake actuator.

4. The wheelset bearing as claimed in claim 3, wherein the at least one brake actuators is a caliper brake.

5. The wheelset bearing as claimed in claim 3, further comprising:

a wheelset;

wherein at least one brake disk is mounted on an axle of the wheelset.

6. The wheelset bearing as claimed in claim 2, wherein the torsion spring is fabricated in one piece and is directly connected to one bearing housing in each case.

7. The wheelset bearing as claimed in claim 2, further comprising:

levers fixedly joined to the torsion spring at each of the two ends of the torsion spring and including an angle with the longitudinal direction of the torsion spring.

8. The wheelset bearing as claimed in claim 2, wherein at least the middle section of the torsion spring is rod-shaped.

9. The wheelset bearing as claimed in claim 1, wherein the torsion spring is fabricated in one piece and is directly connected to one bearing housing in each case.

10. The wheelset bearing as claimed in claim 9, wherein that the two ends of the torsion spring are formed bent relative to the middle section of the torsion spring.

11. The wheelset bearing as claimed in claim 1, further comprising:

levers fixedly joined to the torsion spring at each of the two ends of the torsion spring and including an angle with the longitudinal direction of the torsion spring.

12. The wheelset bearing as claimed in claim 1, characterized in that the torsion spring is fabricated from spring steel.

13. The wheelset bearing as claimed in claim 1, further comprising:

a wheelset; and an inside bearing truck;

wherein the bearing housing is connected in an articulated manner to a truck frame by way of a wheelset guide bushing, while no direct connection exists between the truck frame and torsion spring.

14. The wheelset bearing having a wheelset and having an inside bearing truck as claimed in claim 13, wherein at least a middle part of the torsion spring is arranged parallel to a wheel axis in proximity to a connecting line between two wheelset guide bushings.

15. The wheelset bearing having a wheelset and having an inside bearing truck as claimed in claim 14, wherein a bearing for realizing the connection to the frame of the truck is provided in each wheelset guide bushing, axis of rotation of the bearing including an angle with the middle section of the torsion spring.

16. The wheelset bearing having a wheelset and having an inside bearing truck as claimed in claim 14 and also having a wheelset drive, wherein at least a middle section of the torsion spring forms part of a torque support for the wheelset drive.

17. The wheelset bearing having a wheelset and having an inside bearing truck as claimed in claim 13, wherein a bearing for realizing the connection to the frame of the truck is provided in each wheelset guide bushing, axis of rotation of the bearing including an angle with the middle section of the torsion spring.

18. The wheelset bearing having a wheelset and having an inside bearing truck as claimed in claim 13 and also having a wheelset drive, wherein at least a middle section of the torsion spring forms part of a torque support for the wheelset drive.

* * * * *